US007450079B1

(12) United States Patent
Baldauf et al.

(10) Patent No.: US 7,450,079 B1
(45) Date of Patent: Nov. 11, 2008

(54) GIMBALED GREGORIAN ANTENNA

(75) Inventors: John E. Baldauf, Redondo Beach, CA (US); Eric D. Lee, Sherman Oaks, CA (US); Joel R. Dixon, Torrance, CA (US); David Bressler, Los Angeles, CA (US)

(73) Assignee: The Boeing Company, Chicago, IL (US)

( * ) Notice: Subject to any disclaimer, the term of this patent is extended or adjusted under 35 U.S.C. 154(b) by 354 days.

(21) Appl. No.: 11/296,106

(22) Filed: Dec. 7, 2005

(51) Int. Cl.
*H01Q 13/00* (2006.01)

(52) U.S. Cl. ..... 343/781 CA; 343/781 P

(58) Field of Classification Search ..... 343/781 CA, 343/781 P, 785, 909
See application file for complete search history.

(56) References Cited

U.S. PATENT DOCUMENTS 6,061,033 A * 5/2000 Hulderman et al. ... 343/781 CA
7,015,867 B1 * 3/2006 Miller et al. ..... 343/781 P

* cited by examiner

*Primary Examiner*—Shih-Chao Chen
(74) *Attorney, Agent, or Firm*—Jonathan W. Hallman; MacPherson Kwok Chen & Heid LLP

(57) ABSTRACT

In one embodiment, a gimbaled reflector antenna is provided that includes only four reflectors comprising: a first flat plate reflector, a second flat plate reflector, and an ellipsoidal reflector, and a parabolic reflector. By rotating some or all of the reflectors with respect to a fixed feed, a projected beam may be scanned across a hemispherical field of regard.

16 Claims, 3 Drawing Sheets

GIMBALED GREGORIAN ANTENNA

STATEMENT REGARDING FEDERALLY SPONSORED RESEARCH OR DEVELOPMENT

This invention was made with Government support under contract number FA8808-04-C-0022 awarded by the U.S. Air Force. The Government has certain rights in this invention.

TECHNICAL FIELD

This invention relates to antennas, and more particularly to a gimbaled reflector antenna.

BACKGROUND

Gimbaled reflector antennas provide a high gain signal path over a wide field of regard extending beyond the beam width of a fixed antenna of equivalent design. This high gain signal path is provided by mechanically steering the beam to a desired location through appropriate actuation of the associated gimbals. In this fashion, a gimbaled reflector antenna may be used to track moving targets regardless of whether the antenna position itself is also changing. Gimbaled reflector antennas may also perform sequential acquisition of multiple targets at multiple positions or be used to move a fixed set of multiple beams to different locations. Thus, gimbaled reflector antennas have numerous applications in both wireless communication systems and sensor systems.

As illustrated in FIG. 1, a conventional gimbaled reflector antenna system 100 having a large field of regard requires an antenna feed 105 and a reflector 110 to remain fixed with respect to each other to minimize gain performance degradation. Because of their fixed spatial relationship, feed 105 and reflector 110 must move in tandem. Thus, to accommodate scanning of reflector antenna system 100 requires either a rotating or a flexible electrical connection 120 to carry signals to feed 105. Typical systems use rotary joints or slip rings or flexible cables with large service loops. To minimize RF front end losses, a low noise amplifier (LNA) 130 should be placed as close are possible to feed 105, often requiring it to move with the feed. The addition of LNA(s) 130, associated power supplies, and thermal control features introduce extra gimbaled mass that complicates the electrical and mechanical design of system 100.

To eliminate the complications associated with a fixed feed/reflector design, one current approach is to use what is called a "beam waveguide" that eliminates "hard" electrical connections (connection made with cables, waveguide, or other physical media such as flexible electrical connection 120) through the gimbals of a reflector system. A beam waveguide is a multiple reflector system that produces an image of the feed that is displaced from where the feed is located. This feed image orientation can be changed by rotation of one or more of the beam waveguide reflectors. This image of the feed is then used to feed a focused reflector system, producing the high gain spot pattern. Conventional beam waveguide systems require four or five reflectors in addition to two reflectors for the final focused main reflector. This large number of reflectors requires complicated design, assembly, and alignment procedures. For electrically small antenna systems, this may be impractical.

Another approach to providing large field of regard is to use a phased array antenna. Phased array antennas require small element spacing for large scan angles, resulting in a large number of elements for a given gain requirement. In addition, it difficult and expensive to produce an array that looks over a spherical field of regard of pi steradians. Moreover, the number of active electronic devices such as amplifiers and phase shifters typically make the cost prohibitive.

Accordingly, there is a need in the art for improved gimbaled reflector antenna systems that provide a large field of regard.

BRIEF SUMMARY

In an exemplary embodiment, a gimbaled reflector antenna is provided that includes: a Gregorian antenna having a sub-reflector and a main reflector; a feed; a first reflector; a second reflector, wherein the first reflector is adapted to reflect a beam from the feed to the second reflector, the second reflector is adapted to reflect the beam to the sub-reflector, and the sub-reflector is adapted to reflect the beam to the main reflector; an elevation gimbal adapted to rotate both the second reflector and the Gregorian reflector with respect to the first reflector; and an azimuth gimbal adapted to rotate the first reflector with respect to the feed.

In another exemplary embodiment, a gimbaled antenna system is provided that includes: a Gregorian antenna having a sub-reflector and a main reflector; a feed; a first reflector; a second reflector, wherein the first reflector is adapted to reflect a beam from the feed to the second reflector, the second reflector is adapted to reflect the beam to the sub-reflector, and the sub-reflector is adapted to reflect the beam to the main reflector; an azimuth gimbal adapted to rotate the first reflector, the second reflector, and the Gregorian antenna with respect to the feed; and an elevation gimbal adapted to rotate both the second reflector and the Gregorian reflector with respect to the first reflector.

A better understanding of the above and many other features and advantages of the present invention may be obtained from a consideration of the detailed description of the exemplary embodiments thereof below, particularly if such consideration is made in conjunction with the appended drawings, wherein like reference numerals are used to identify like elements illustrated in one or more of the figures therein.

DETAILED DESCRIPTION

Reference will now be made in detail to one or more embodiments of the invention. While the invention will be described with respect to these embodiments, it should be understood that the invention is not limited to any particular embodiment. On the contrary, the invention includes alternatives, modifications, and equivalents as may come within the spirit and scope of the appended claims. Furthermore, in the following description, numerous specific details are set forth to provide a thorough understanding of the invention. The invention may be practiced without some or all of these specific details. In other instances, well-known structures and principles of operation have not been described in detail to avoid obscuring the invention.

Figure 1:
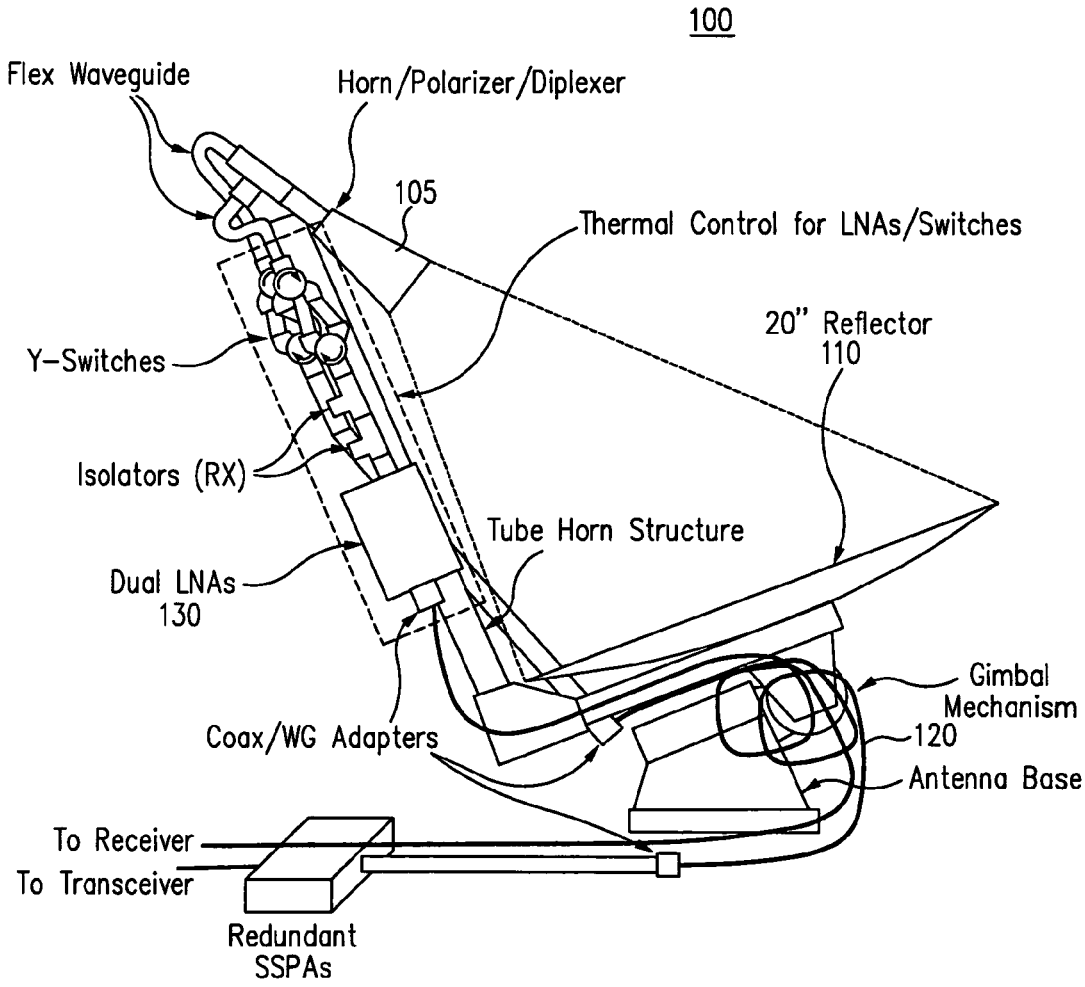
FIG. 1 (PRIOR ART)
FIG. 1 is a side elevation view of a conventional gimbaled reflector antenna system.
Figure 2:
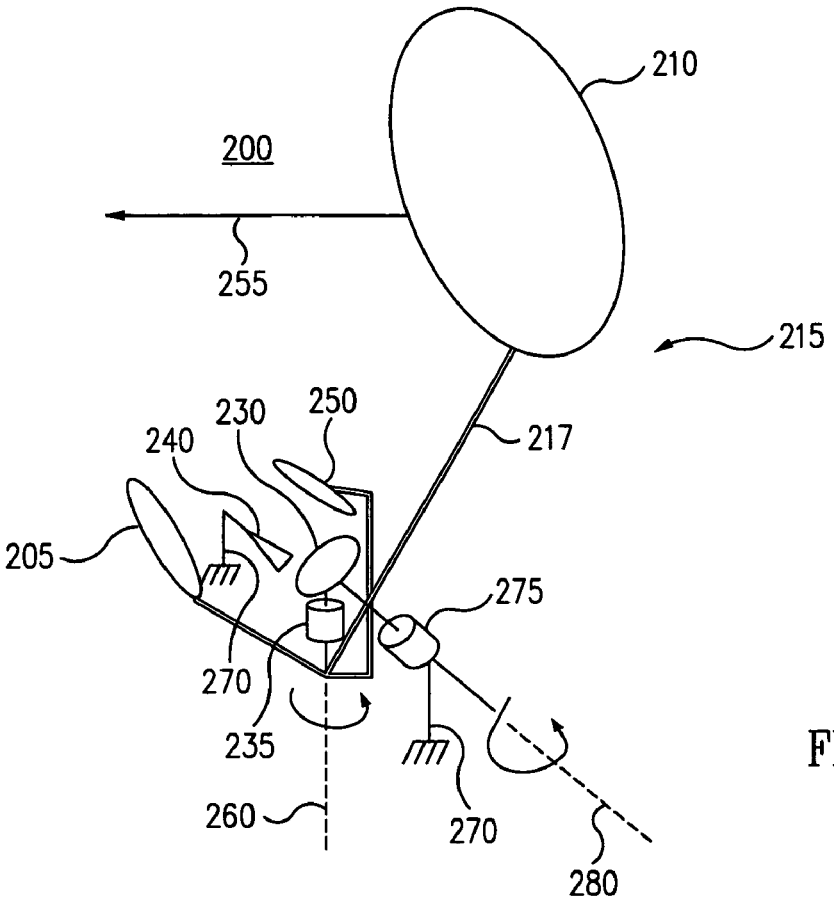
FIG. 2 is an isometric view of a gimbaled reflector antenna system in accordance with a first embodiment of the invention.

To avoid the aforementioned problems in the prior art, a beam waveguide gimbaled reflector antenna is provided that includes as few as four mirror elements. Turning now to FIG. 2, an isometric view of a first exemplary embodiment of a beam waveguide gimbaled reflector antenna 200 is illustrated. An ellipsoidal sub-reflector 205 and a parabolic main reflector 210 form a Gregorian antenna sub-system 215 supported by a frame 217. A first flat plate reflector 230 reflects an RF beam from a feed such as a feed horn 240 towards a second flat plate reflector 250. In turn, the RF beam is reflected from second flat plate reflector 250 to ellipsoidal sub-reflector 205. Finally, the RF beam is then reflected from ellipsoidal sub-reflector 205 to parabolic main reflector 210, which then reflects the RF beam into the desired pointing direction as a projected RF beam 255. Second flat plate 250 mounts to frame 217 and is thus fixed with respect to Gregorian sub-system 215. However, first flat plate 230 mounts to frame 217 through an azimuth gimbal 235 and is thus not fixed with regard to Gregorian sub-system 215. Through actuation of azimuth gimbal 235, Gregorian sub-system 215 rotates on an azimuth axis 260 with regard to first flat plate 230 to thereby scan projected beam 255 in the azimuth direction.

Because antenna 200 is a beam wave guide antenna in which feed horn 240 is fixed with respect to the remaining antenna components, feed horn 240 mounts on a substrate 270 that forms the mounting reference for antenna 200. For example, in a space-based application, substrate 270 would comprise the spacecraft that incorporates antenna 200. First flat plate reflector 230 also mounts on substrate 270 through an elevation gimbal 275. Thus, as elevation gimbal 275 is actuated, first flate plate 230, azimuth gimbal 235, second flat plate 250, and Gregorian sub-system 215 rotate about an elevation axis such that projected beam 255 is scanned in the elevation direction. Advantageously, the image of the feed in main reflector 210 does not change with regard to azimuth or elevation scan angle changes provided that the feed radiation from feed horn 240 is symmetrical about its axis. Thus, the antenna performance is unperturbed as antenna 200 is scanned to a desired azimuth and elevation location, provided that surrounding structure comprising substrate 270 does not electrically interfere with projected beam 255. In this fashion, hemispherical fields of regard may be achieved with no degradation in antenna performance with just four reflectors. In addition, because the gimbaled mass is reduced through the use of just four reflectors, light weight gimbals may be used, further decreasing the overall mass.

Figure 3:
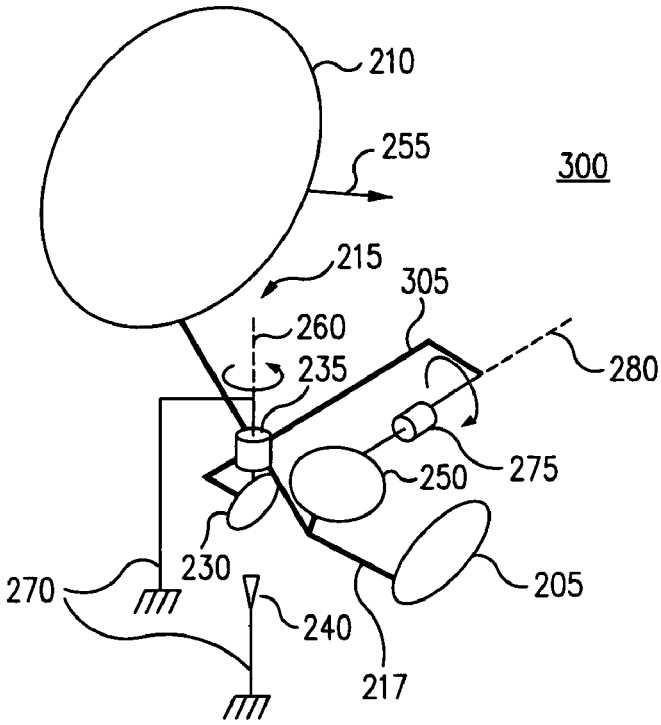
FIG. 3 is an isometric view of a gimbaled reflector antenna in accordance with a second embodiment of the invention.

Turning now to FIG. 3, an isometric view of a second exemplary embodiment of a beam waveguide gimbaled reflector antenna 300 is illustrated. In antenna 300, it is azimuth gimbal 235 that mounts to substrate 270. First flat plate 230 mounts through a frame member 305 to elevation gimbal 275. Second flat plate 250 mounts to elevation gimbal 275 as well as to frame 217 holding Gregorian sub-system 215. Thus, in an azimuth scan, azimuth gimbal 235 rotates the remaining components of antenna 300 about azimuth axis 260 such that beam 255 scans in the azimuth direction. Similarly, in an elevation scan, elevation gimbal 275 rotates Gregorian sub-system 215 and second flat plate 250 about elevation axis 280 such that beam 255 scans in the elevation direction.

Figure 4:
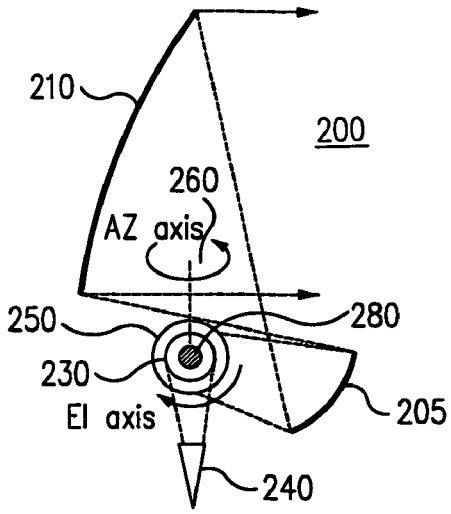
FIG. 4 is a cutaway side view of the gimbaled reflector antenna system of FIG. 3 showing only the reflectors.
Figure 5:
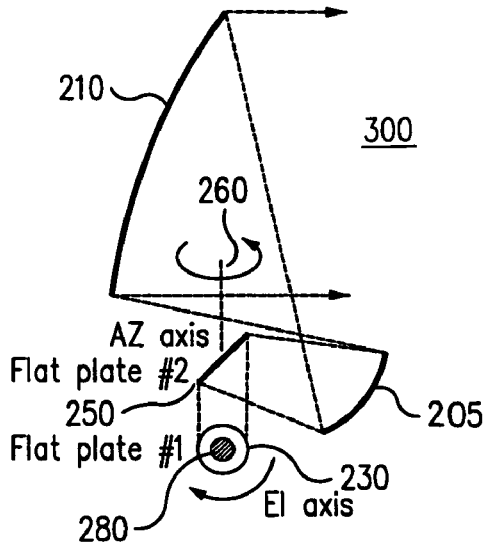
FIG. 5 is a cutaway side view of the gimbaled reflector antenna system of FIG. 2 showing only the reflectors.
Figure 6:
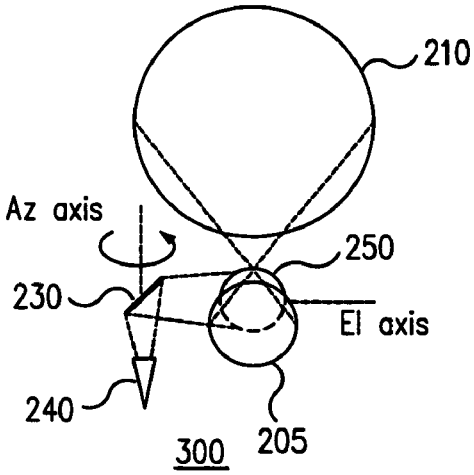
FIG. 6 is a cutaway front view of the gimbaled reflector antenna system of FIG. 3 showing only the reflectors.
Figure 7:
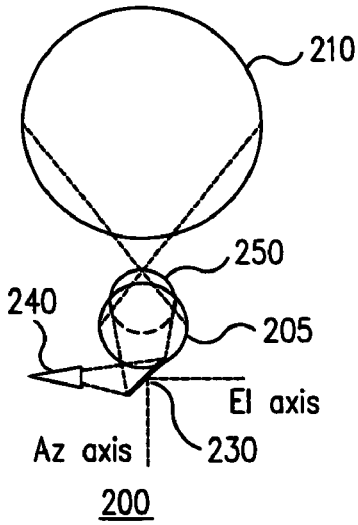
FIG. 7 is a cutaway front view of the gimbaled reflector antenna system of FIG. 2 showing only the reflectors.

A comparison of antennas 200 and 300 shows that elevation axis 280 is closer to main reflector 210 in antenna 300 as compared to antenna 200. To better reflect this feature, cutaway side views showing only the reflectors (for better illustration clarity) for antennas 300 and 400 are shown in FIGS. 4 and 5, respectively. Corresponding cutaway front views showing only the reflectors for antennas 300 and 400 are shown in FIGS. 6 and 7, respectively. Design variables including manufacturability and system integration requirements may dictate whether elevational axis 280 should be as shown in antennas 200 or 300.

By now, those of skill in this art will appreciate that many modifications, substitutions and variations can be made in and to the materials, apparatus, configurations of the present invention without departing from its spirit and scope. Accordingly, the scope of the present invention should not be limited to the particular embodiments illustrated and described herein, as they are merely exemplary in nature, but rather, should be fully commensurate with that of the claims appended hereafter and their functional equivalents.

What is claimed is:

1. A gimbaled reflector antenna, comprising:

a Gregorian antenna having a sub-reflector and a main reflector;

a feed;

a first reflector;

a second reflector, wherein the first reflector is adapted to reflect a beam from the feed to the second reflector, the second reflector is adapted to reflect the beam to the sub-reflector, and the sub-reflector is adapted to reflect the beam to the main reflector;

an elevation gimbal adapted to rotate both the second reflector and the Gregorian antenna with respect to the first reflector; and an azimuth gimbal adapted to rotate the first reflector, the second reflector, and the Gregorian antenna with respect to the feed.

2. The gimbaled reflector antenna of claim 1, wherein the sub-reflector is an ellipsoidal sub-reflector.

3. The gimbaled reflector antenna of claim 1, wherein the main reflector is a parabolic reflector.

4. The gimbaled reflector antenna of claim 1, wherein the first reflector is a flat plate reflector.

5. The gimbaled reflector antenna of claim 1, wherein the second reflector is a flat plate reflector.

6. The gimbaled reflector antenna of claim 5, wherein the elevation gimbal and the feed are both connected to a spacecraft.

7. The gimbaled reflector antenna of claim 1, wherein the feed is a feed horn.

8. A gimbaled reflector antenna, comprising:

a Gregorian antenna having a sub-reflector and a main reflector;

a feed;

a first reflector;

a second reflector, wherein the first reflector is adapted to reflect a beam from the feed to the second reflector, the second reflector is adapted to reflect the beam to the sub-reflector, and the sub-reflector is adapted to reflect the beam to the main reflector;

an azimuth gimbal adapted to rotate the first reflector, the second reflector, and the Gregorian antenna with respect to the feed; and an elevation gimbal adapted to rotate both the second reflector and the Gregorian reflector with respect to the first reflector.

9. The gimbaled reflector antenna of claim 8, wherein the sub-reflector is an ellipsoidal sub-reflector.

10. The gimbaled reflector antenna of claim 8, wherein the main reflector is a parabolic reflector.

11. The gimbaled reflector antenna of claim 8, wherein the first reflector is a flat plate reflector.

12. The gimbaled reflector antenna of claim 8, wherein the second reflector is a flat plate reflector.

13. The gimbaled reflector antenna of claim 8, wherein the aximuth gimbal and the feed are both connected to a spacecraft.

14. The gimbaled reflector antenna of claim 8, wherein the feed is a feed horn.

15. A method of transmitting an RF signal, comprising:

transmitting the RF signal from a source to a first reflector;

reflecting the RF signal from the first reflector to a second reflector;

reflecting the RF signal from the second reflector to an ellipsoidal reflector;

reflecting the RF signal from the ellipsoidal reflector to a parabolic reflector;

reflecting the RF signal from the parabolic reflector to form a transmitted RP beam;

rotating all of the reflectors about an azimuth axis passing through the first reflector to scan the transmitted RF beam in an azimuth direction; and rotating the second reflector, the ellipsoidal reflector, and the parabolic reflector about an elevation axis passing through the second reflector to scan the transmitted RF beam in an elevation direction.

16. The method of claim 15, wherein the first and second reflectors are flat plate reflectors.

* * * * *